US009132320B2

(12) United States Patent
McNall et al.

(10) Patent No.: US 9,132,320 B2
(45) Date of Patent: Sep. 15, 2015

(54) DEVICES, SYSTEMS, AND METHODS FOR REFURBISHING ONE OR MORE LACROSSE BALLS

(71) Applicant: LAX DR., LLC, Draper, UT (US)

(72) Inventors: Eugene M. McNall, Draper, UT (US); Charles W. McNall, Cedar Hills, UT (US)

(73) Assignee: LAX DR., LLC, Draper, UT (US)

( * ) Notice: Subject to any disclaimer, the term of this patent is extended or adjusted under 35 U.S.C. 154(b) by 110 days.

(21) Appl. No.: 13/844,433

(22) Filed: Mar. 15, 2013

(65) Prior Publication Data

US 2014/0038495 A1 Feb. 6, 2014

Related U.S. Application Data

(60) Provisional application No. 61/680,241, filed on Aug. 6, 2012, provisional application No. 61/710,609, filed on Oct. 5, 2012.

(51) Int. Cl.

| | |
|---|---|
| ***B24B 11/00*** | (2006.01) |
| ***A63B 47/00*** | (2006.01) |
| ***B24B 11/06*** | (2006.01) |
| ***B24B 41/04*** | (2006.01) |

(52) U.S. Cl.

CPC ..... *A63B 47/00* (2013.01); *B24B 11/06* (2013.01); *B24B 41/042* (2013.01); *A63B 2243/005* (2013.01)

(58) Field of Classification Search

CPC ..... B24B 11/06; B24B 41/047; B24B 29/04; B24B 41/02; A63B 2243/005

USPC ..... 451/50, 326, 327, 357

See application file for complete search history.

(56) References Cited

U.S. PATENT DOCUMENTS

| | | | | |
|---|---|---|---|---|
| 3,466,815 | A * | 9/1969 | Balz | 451/32 |
| 3,654,655 | A * | 4/1972 | Mitnick | 15/21.2 |
| 3,990,188 | A * | 11/1976 | Balz | 451/113 |
| 4,791,694 | A * | 12/1988 | Itaya et al. | 15/97.1 |
| 5,040,340 | A * | 8/1991 | Bischof et al. | 451/357 |
| 5,546,629 | A * | 8/1996 | Shim | 15/302 |
| 6,695,509 | B1 | 2/2004 | Dowe, Sr. | |
| D487,668 | S | 3/2004 | Sands | |
| D488,892 | S | 4/2004 | Hon et al. | |
| 6,821,191 | B2 * | 11/2004 | Lim et al. | 451/50 |
| 6,887,135 | B2 * | 5/2005 | Lim et al. | 451/50 |
| D618,868 | S | 6/2010 | Schouten | |
| 8,550,882 | B2 * | 10/2013 | Shim | 451/103 |
| 2006/0260075 | A1 * | 11/2006 | Sun | 15/21.2 |
| 2009/0098809 | A1 * | 4/2009 | Shim | 451/66 |
| 2012/0058715 | A1 | 3/2012 | Roze | |

* cited by examiner

*Primary Examiner* — Maurina Rachuba

(74) *Attorney, Agent, or Firm* — David L. Stott

(57) ABSTRACT

A method and system for resurfacing one or more lacrosse balls is provided. The system includes a container, a rotatable member, and a motor. The container is configured to hold the one or more lacrosse balls. The rotatable member includes an abrasive surface configured to scuff the lacrosse balls while in the container, The motor includes a drive shaft coupled to the rotatable member and configured to facilitate rotation of the rotatable member. With this arrangement, the lacrosse balls are positioned over the abrasive surface such that, upon rotation of the rotatable member the abrasive surface scuffs the lacrosse balls to, thereby, resurface the balls.

14 Claims, 4 Drawing Sheets

DEVICES, SYSTEMS, AND METHODS FOR REFURBISHING ONE OR MORE LACROSSE BALLS

CROSS-REFERENCE TO RELATED APPLICATIONS

This application claims the benefit of U.S. Provisional Application No. 61/680,241, filed Aug. 6, 2012, and U.S. Provisional Application No. 61/710,609, filed Oct. 5, 2012, the contents of each of which are hereby incorporated by reference in their entirety.

TECHNICAL FIELD

The present invention relates generally to refurbishing lacrosse balls. More specifically, the present invention relates to a method and system for resurfacing lacrosse balls.

BACKGROUND

The popularity of the game of lacrosse has grown immensely over the last decade. Surprisingly, one of the major on-going costs for lacrosse programs and individual players alike is the cost of lacrosse balls. The lacrosse ball is a polymeric sphere with a petroleum base product. Although the cost for an individual ball runs about two to four dollars, the problem is the surface of the balls quickly become slick, making it difficult for players to accurately throw and control the balls from the pocket of a lacrosse stick. New lacrosse balls have a certain level of grip to them that players demand due to the grip providing the player greater accuracy and control over the ball and, further, allowing the players to throw the ball at higher speeds. Due to the balls petroleum base product, the grip on the balls quickly wears off and becomes slippery, resulting in balls that are difficult to use compared to the new halls with the appropriate grip surface. As such, replacing the slippery balls for new lacrosse balls is an on-going cost for lacrosse programs and individual players. Further, replacing slick lacrosse balls with new lacrosse balls is wastefid and unacceptable when considering the large volume of lacrosse balls in the U.S. alone and the potential impact polymeric/petroleum based products have on the environment.

Based on the foregoing, it would be advantageous to develop a system and method that would allow players to use the same lacrosse balls for longer periods of time and, therefore, reduce the costs for lacrosse programs and individual players and, further, limit the impact that lacrosse balls may have on the environment.

BRIEF SUMMARY OF THE INVENTION

Embodiments of the present invention are directed to various devices, methods, and systems for modifying the surface of one or more lacrosse balls. For example, in accordance with one embodiment of the present invention, a resurfacing system for resurfacing one or more lacrosse balls is provided. The system includes a container, a rotatable member, and a motor. The container is configured to contain the one or more lacrosse balls. The rotatable member includes an abrasive surface such that the abrasive surface is configured to scuff the one or more lacrosse balls contained in the container. The motor includes a drive shaft coupled to the rotatable member and is configured to facilitate rotation of the rotatable member.

In one embodiment, the rotatable member includes a rotatable member central axis and the drive shaft defines a drive shaft axis such that the central axis is non-coaxial with the drive shaft axis. In another embodiment, the rotatable member includes a central axis and the drive shaft defines a drive shaft axis such that the central axis and the drive shaft axis are co-axial.

In another embodiment, the rotatable member comprises a plate portion and a counter-weight portion such that the counter-weight portion is sized and configured to oscillate and rotate the plate portion. In another embodiment, the rotatable member comprises a plate portion with the abrasive surface and a counter-weight portion such that the counter-weight portion is rotatably coupled to the plate portion and directly coupled to the drive shaft of the motor. Such drive shaft, in another embodiment, defines a drive shaft axis, wherein the drive shaft axis is non-coaxial with a central axis of the plate portion. In another embodiment, upon rotational movement of the counter-weight portion via the drive shaft, the counter-weight portion rotates the plate portion with centrifugal force generated by the counter-weight portion.

In still another embodiment, the rotatable member includes at least one layer of conformable material positioned below the abrasive surface. In another embodiment, the container defines an inner surface and an outer surface, the inner surface including one or more bumpers such that the one or more bumpers are configured to disrupt consistent movement of the one or more lacrosse balls in the container upon movement of the rotatable member. In another embodiment, the system includes a tinier associated with the motor, the tinier configured to automatically turn the motor off after a pre-determined period of time.

In accordance with another embodiment of the present invention, a resurfacing system for resurfacing one or more lacrosse balls is provided. The resurfacing system includes a container, a motor, a plate member, and a counter-weight. The container is configured to contain the one or more lacrosse balls. The motor is coupled to the container and includes a drive shaft that extends vertically upward from the motor. The drive shaft defines a drive shaft axis. The plate member defines a plate central axis and includes an upper abrasive surface and an underside. The counter-weight is rotatably coupled to the underside of the plate member such that the counter-weight is coupled to the drive shaft of the motor. With this arrangement, the drive shaft axis is non-coaxial with the plate central axis.

In one embodiment, upon rotation of the counter-weight via the drive shaft, the plate member rotates via centrifugal force generated by the counter-weight. In another embodiment, upon rotation of the counter-weight via the drive shaft, the plate member rotates with an oscillating arrangement.

In another embodiment, the plate member includes one or more layers of conformable material with the upper abrasive surface coupled thereto. In another embodiment, the container includes an inner surface with one or more bumpers configured to disrupt consistent movement of the one or more lacrosse balls.

In accordance with another embodiment of the present invention, a method for resurfacing one or more lacrosse halls is provided. The method includes placing one or more lacrosse balls into a container; and rotating a rotatable member with a motor operably coupled thereto such that movement of the rotatable member moves the one or more lacrosse balls within the container to be scuffed against an abrasive surface within the container.

In another embodiment, the rotating step includes rotating the rotatable member so that the one or more lacrosse balls move against a bumper disposed on an inner surface of the container for disrupting consistent movement of the one or more lacrosse balls within the container.

In another embodiment, the rotating step includes rotating a counter-weight of the rotatable member with a drive shaft of the motor such that the drive shaft includes a drive shaft axis that is non-coaxial with the central axis of the rotatable member. In still another embodiment, the rotating step includes rotating a counter-eight portion of the rotatable member with a drive shaft of the motor, the rotatable member including a plate portion having the abrasive surface and the counter-weight portion rotatably coupled to an under-side of the plate portion, the drive shaft having a drive shaft axis that is non-coaxial with the central axis of the rotatable member. In yet another embodiment, the rotating step includes driving the rotatable member with a drive shaft of the motor, the drive shaft being co-axial with a central a is of the rotatable member.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
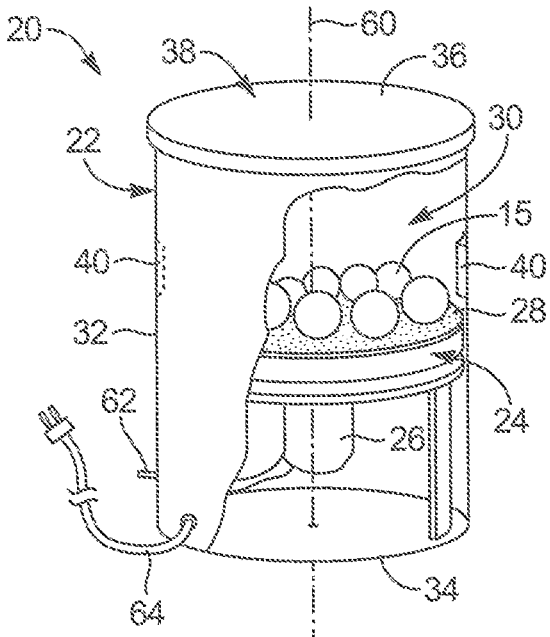
FIG. 1 is a perspective view of a resurfacing system, depicting a container with a portion removed to exhibit a rotatable member and motor disposed therein, according to an embodiment of the present invention.

Referring to FIG. 1, an embodiment of a resurfacing system 20 to resurface one or more lacrosse balls 15 is provided. Such a resurfacing system 20 may include a container 22, a rotatable member 24 and a motor 26. The rotatable member 24 may include an abrasive surface 28 and rotate by means of the motor 26. The one or more lacrosse balls 15 placed in the container 22 and positioned over the abrasive surface 28 may be moved and tossed within the container 22 as the rotatable member 24 moves therein such that the one or more lacrosse balls 15 become scuffed against the abrasive surface 28 in a random manner. With such an arrangement, the resurfacing system 20 may be employed to resurface an exterior surface of the one or more lacrosse balls 15 that have become relatively slick over time and through use. The resurfacing process substantially restores the lacrosse balls 15 to their original grip surface.

The container 22 may be a housing for one or more portions of the resurfacing system 20. In one embodiment, the container 22 may be the housing for the rotatable member 24 and the motor 26 and may define a ball scuff space 30, The ball scuff space 30 may be a space within the container 22 or housing that the one or more lacrosse balls 15 may be initially placed over the abrasive surface 28 of the rotatable member 24 while being contained within the ball scuff space 30 and, upon rotation of the rotatable member 24, the balls are randomly tossed, bouncing against the walls of the container 22 and against the abrasive surface 28 in order to scuff the balls 15.

The container 22 may include a cylindrical shape with a side wall 32, a bottom wall 34, and an upper wall 36. In one embodiment, the container 22 may be in the form of for example, a bucket, such as a five gallon bucket. The upper wall 36 may be removable in the form of for example, a lid 38, in order to provide access to the ball scuff space 30 within the container 22. Such an upper wall 36 or lid 38 may fit over the side wall 32 with an interference type it or wilth integrally extending protrusions to provide a snap type fit over the side wall 32. In another embodiment, the upper wall 36 may be threaded to removeably attach to the side wall 32 or to be threaded to one OT more intermediate pieces between the side wall 32 and the upper wall 36. In another embodiment, the upper wall 36 may include one or more latches or spring-biased clamps to secure the upper wall 36 to the side wall 32. In still another embodiment, the upper wall 36 may include a latch on one side and a hinge on the other to open the container 22 to thereby access the ball scuff space 30. In another embodiment, the side wall 32 may include a side wall portion that is openable with, for example, a latchillinge type opening in order to access the ball scuff space 30.

In another embodiment, the side wall 32 may include a bumper portion 40. The bumper portion 40 may protrude and extend from an interior surface of the side wall 32. The bumper portion 40 may be attached to the side wall 32 employing fasteners or the bumper portion 40 may be integrally formed or monolithically formed along the interior surface of the side wall 32. The bumper portion 40 may be positioned at a height above the rotatable member 24 so that as the one or more lacrosse balls 15 are moving within the ball scuff space 30, the movement of the one or more balls 15 is disrupted from consistent movement. In this manner, upon rotation of the rotatable member 24, the one or more balls 15 within the ball scuff space 30 move and knock against the bumper portion 40 and randomly bounce within the ball scuff space 30 to be scuffed against the abrasive surface 28 of the rotatable member 24.

In one embodiment, the ball scuff space 30 may include a diameter of about eleven inches and a height of about five inches. Such ball scuff space 30 may fit between about ten to thirteen lacrosse balls with adequate spacing to undergo the resurfacing process for about one minute. If additional balls 15 are placed within the ball scuff space 30, the resurfacing process may take additional time. Of course, the ball scuff space 30 may be designed with a larger volume to undergo the resurfacing process for a larger volume of lacrosse balls as desired.

Figure 2:
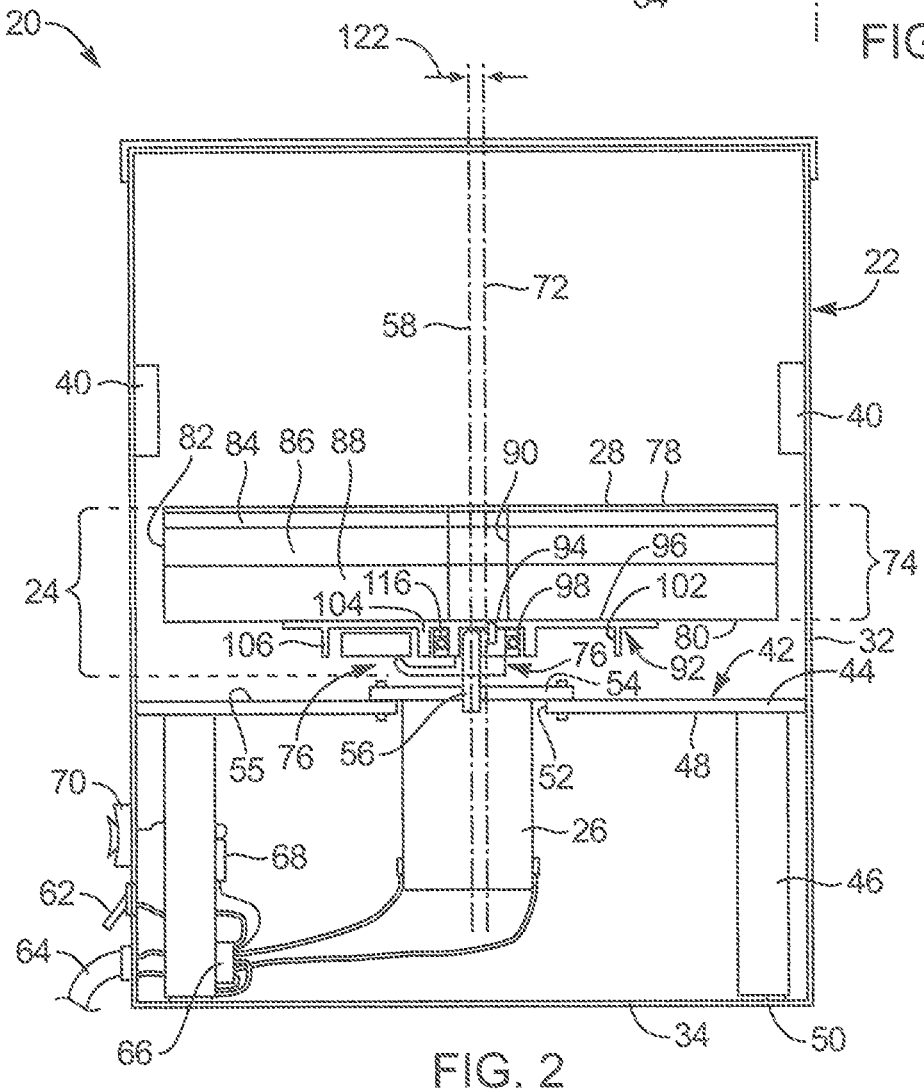
FIG. 2 is a cross-sectional view of the resurfacing system taken along section line 2 of FIG. 1, according to another embodiment of the present invention.

With reference now to FIGS. 1 and 2, the container 22 may include a motor mount 42 for mounting the motor 26 thereto. In one embodiment, the motor mount 42 may be, a separate component secured to a portion of the container 22. In another embodiment, the motor mount 42 may be integrally formed with the container 22 or housing. The motor mount 42 may include a plattbrm 44 with one or more legs 46 extending downward therefrom. The platform 44 may be sized and configured to be positioned snug against the side wall 32 of the container 22 and within the container 22. The one or more legs 46 may extend between a bottom surface 48 of the platform 44 to the bottom wall 34 of the container 22. The legs 46 may also include leg pads 50 sized and configured to dampen vibration from the motor 26. The legs 46 may be secured to the platform 44 with, for example, screws or staples or any other suitable fastening means. Further, the legs 46 may be fastened to the bottom wall 34 with, for example, screws, staples, or adhesive.

The platform 44 may also include a central platform opening 52 defined therein. The central platform opening 52 may be sized and configured to receive and position an upper portion of the motor 26 therein. For example, the motor 26 may include a motor bracket 54. Such a bracket 54 may be formed integrally with the motor housing or be a separate component attached to the motor 26. The motor bracket 54 may be positioned over the central platform opening 52 with a bracket periphery positioned over an upper surface 55 of the platform 44. The motor bracket 54 may include bolt openings defined therein so as to facilitate the motor bracket 54 to be secured directly to the platform 44. With this arrangement, the motor 26 may be secured to the platform so as to be suspended within the central platform opening 52 and below the platform 44 with the motor bracket 54 secured with, for example, a bolt and nut arrangement. The platform may be made from a rigid material, such as a polymeric material, wood, etc., or any other suitable rigid matefial.

The motor 26 employed with the resurfacing system 20 includes a drive shaft 56 configured to rotate about a drive shaft axis 58. The drive shaft axis 58 may also be co-axial with an axis 60 defined by the container 22. The drive shaft 56 may extend vertically upward from the motor 26 and, further, may be sized and configured to extend above the platform 44 to couple to the rotatable member 24, discussed in more detail hereafter.

The motor 26 may be powered electrically from a power source (not shown), such as an electrical outlet. In another embodiment, the motor 26 may be powered by batteries or a battery pack or the like. The motor 26 may be electrically coupled to a switch 62 mounted to the housing or container 22, the switch configured to be moved between an on position and an off position to electrically turn the motor 26 on or off. The motor 26 may include a power cord 64 to couple the motor 26 to a power source. The motor 26 may operate on AC or DC current. For example, in the case of the motor 26 being configured to operate on DC current, the power cord 64 may be coupled to an AC current power source and converted, via an electrical converter 66, to DC current to operate the motor 26. However, as known to one of ordinary skill in the art, the motor 26 may be powered by various means, such as the before mentioned battery pack or the like, or may be electrically coupled to a power source by any suitable means. The motor 26 may be sized so as to drive the drive shaft 56 at, for example, 3200 revolutions per minute employing 120 v and 0.75 amp. As known in the art, other sized motors may be employed depending on the size of the resurfacing system and the torque required for the drive shaft 56 to rotate the rotatable member 24.

In another embodiment, the motor 26 and/or the switch 62 may be associated with a controller 68 and/or a timer 70. Such a controller 68 and/or timer 70 may be configured to control a period of time that the motor 26 is running to drive the drive shaft 56. Such controller 68 and/or timer 70 may be employed with one or more pre-defined periods of time. In another embodiment, the user may pre-set the controller 68 and/or timer 70 for a selected period of time that the motor 26 may he turned on. In this manner, the resurfacing system 20 may employ a controller 68 and/or timer 70 to control the period of time that the rotatable member 24 rotates to resurface the one or more lacrosse balls 15.

Figure 2A:
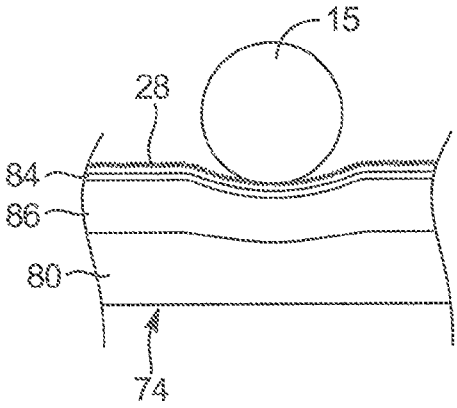
FIG. 2A is an enlarged view of a rotatable member of the resurfacing system, depicting a lacrosse ball contacting an abrasive surface, according to another embodiment of the present invention.
Figure 3:
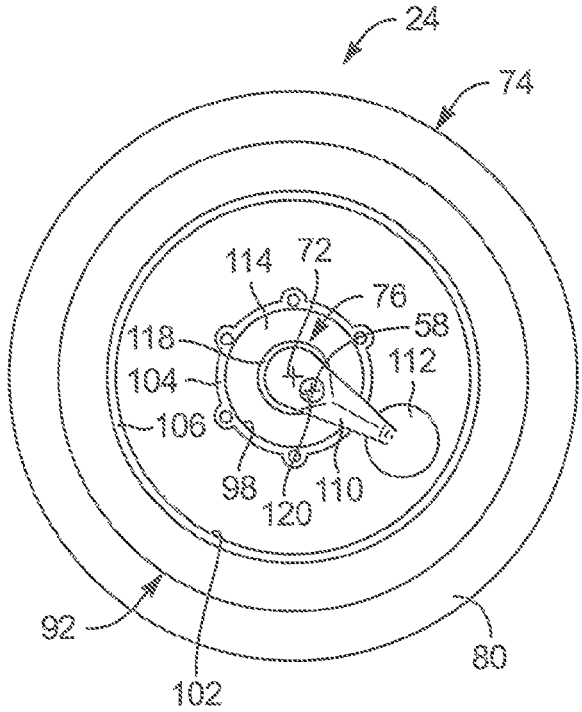
FIG. 3 is a bottom view of the rotatable member of the resurfacing system, depicting, a plate portion and a counter-weight portion of the rotatable member, according to another embodiment of the present invention.

Now with reference to FIGS. 2, 2A and 3, description of the rotatable member 24 and, in particular, a plate portion 74 of the rotatable member will be provided. The rotatable member 24 may include any suitable shape that facilitates scuffing and scrapping lacrosse balls 15. For example, in one embodiment, the rotatable member 24 may be disc shaped. Such rotatable member 24 may define a rotatable member axis 72 and include a plate portion 74 and a counter weight portion 76. The rotatable member axis 72 or plate portion axis may be centrally located within the plate portion 74.

The plate portion 74 may include an upper surface 78 and an under-side surface 80 with a periphery 82 therebetween, the upper surface 78 being the before-discussed abrasive surf lice 28. The plate portion 74 may include one or more layers of material. For example, the plate portion 74 may include multiple layers of various density foam adhesively attached to each other with a layer of, for example, sand paper adhesively attached to the upper most layer of foam to act as the abrasive surface 28. In one embodiment, the plate portion 74 may include a first layer 84, a second layer 86, and a third layer 88 of, for example, foam. The first layer 84 may be a high-density foam material to act as a platform for the sandpaper to be adhesively attached thereto. The second layer 86 may be a low-density foam material, relative to the first layer, to provide a soft cushion material. Such soft cushion material may facilitate the abrasive surface 28 to cup or conform to the lacrosse balls 15 (as depicted in FIG. 2A) as the balls impact and bounce against the abrasive surface 28 as the resurfacing system is in use. In this manner, a larger surface area of the lacrosse balls may be scuffed than that which would result if plate portion 74 was rigid. The third layer 88 may be an intermediate type dense foam material, relative to the high and low density foam material of the respective first and second layers 84, 86. The third layer 88 may act as a support for the rotatable member 24. Each of the above-noted foam layers may define a central opening 90 extending therethrough. Such central opening 90 of the plate portion 74 may be employed to facilitate connection of the drive shaft 56 to the rotatable member 24. Further, the rotatable member axis 72 may be defined centrally through the central opening 90 of the plate portion 74.

As can be well appreciated by one of ordinary skill in the art, the plate portion 74 may employ fewer or more layers of material. For example, in one embodiment, the plate portion 74 may include a single layer of foam with sand paper adhesively attached thereto. In another embodiment, the plate portion 74 may include a single member with an abrasive coating sprayed thereon. Such a coating, rather than sand paper, may also be employed to the upper surface 78 of the one or more layers, discussed above.

Figure 4:
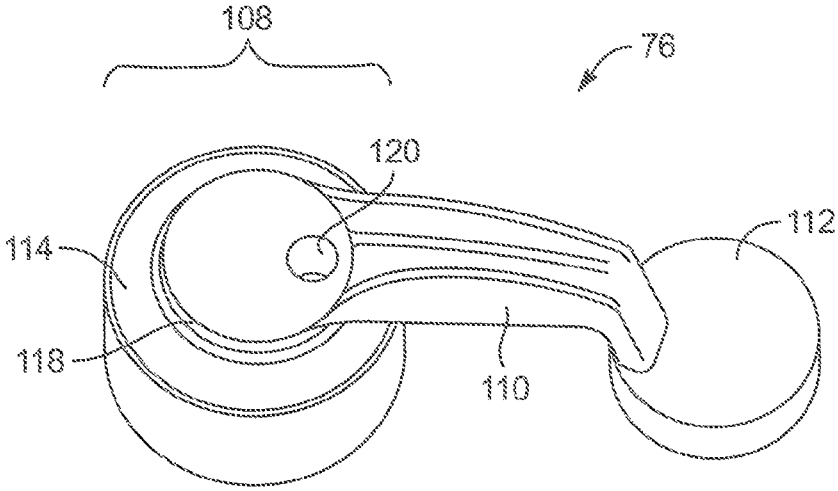
FIG. 4 is a perspective view of a counter-weight portion of the rotatable member depicted in FIG. 3, according to another embodiment of the present invention.

With respect to FIGS. 2, 3, and 4, as previously set forth, the rotatable member 24 may include a counter-weight portion 76. The counter-weight portion 76 may be attached to the under-side surface 80 of the plate portion 74 with a plate mount 92 therebetween. The plate mount 92 may include a flat upper surface with an under-side sized and configured to receive the counter-weight portion 76 of the rotatable member 24. The plate mount 92 includes a plate mount opening 94 defined therein and centrally positioned within the plate mount 92. The upper flat surface of the plate mount 92 may be adhesively attached to the under-side surface 80 of the plate portion 74 such that the plate mount opening 94 corresponds with the central opening 90 of the plate portion 74 of the rotatable member 24. With this arrangement, the plate mount opening 94 and central opening 90 may be symmetrically aligned to define the rotatable member axis 72 extending therethrough.

The plate mount 92 may include a flat portion 96 and at its underside, may define a sleeve portion 98 and a channel portion 102. The sleeve portion 98 may be defined by a first radial wall 104 centrally located and extending downward from the flat portion 96 of the plate mount 92. The channel portion 102 may be defined by the first radial wall 104 and a second radial wall 106 also extending downward from the flat portion 96 of the plate mount 92. The second radial wall 106 may extend radially with a larger radius than the first radial wall such that the channel portion 102 extends radially around the sleeve portion 98 in a symmetrical manner relative to the rotatable member axis 72. With this arrangement, the channel portion 102 exhibits a circular configuration defined by the first and second radial walls 104, 106 of the plate mount 92.

The counter-weight portion 76 may include a central counter-weight portion 108, an arm 110, and a counter-weight 112. The central counter-weight portion 108 may include a bearing portion 114 and an inner rotatable portion 116. The bearing portion 114 may include multiple ball bearings 116 or the like disposed and encased within a ring-like arrangement so as to facilitate the inner rotatable portion 118 to rotate therein. The bearing portion 114 ma he sized and configured to be positioned within the sleeve portion 98 of the plate mount 92 in a fixed manner. In other words, the bearing portion 114 is fixedly positioned relative to the plate mount 92 and, thus, fixed relative to the plate portion 74 of the rotatable member 24. Further, the bearing portion 114 is axially aligned or co-axial with the rotatable member axis 72 or plate portion axis. With the bearing portion 114 fixed to the plate mount 92, the arm 110 extends laterally or transversely, relative to the rotatable member axis 72, to the channel portion 102 of the plate mount 92 with the counter-weight 112 disposed within the channel portion 102 so as to facilitate the counter-weight 112 to move along the circular channel portion 102 as the inner rotatable portion 118 rotates. In this manner, the plate portion 74, being fixed relative to the bearing portion 114, may freely rotate relative to the inner rotatable portion 118 of the counter-weight portion 76.

The counter-weight portion 76 may be rotatably coupled to the drive shaft 56 of the motor 26. For example, the inner rotatable portion 118 of the counter-weight portion 76 may define a hole 120 sized and configured to receive and couple to the drive shaft 56 of the motor 26. In one embodiment, an end portion of the drive shaft 56 may be threaded to correspond with threads at least partially defining the hole 120 in the inner rotatable portion 118. The hole 120 defined in the inner rotatable portion 118 is off-set from the rotatable member axis 72. As such, with the drive shaft 56 coupled to the hole 120 of the counter-weight portion 76, the drive shaft axis 58 and the rotatable member axis 72 are off-set or non-coaxial. In one embodiment, the drive shaft axis 58 may be substantially parallel to the rotatable member axis 72, With this arrangement, the drive shaft 56 directly rotates the counter-weight portion 76 of the rotatable member 24. The rotation of the counter-weight portion 76 provides a centrifugal force in the rotatable member 24 to thereby rotate the plate portion 74 of the rotatable member 24. Such centrifugal force may be enhanced due to the off-set axes, namely, the rotatable member axis 72 and the drive shaft axis 58. Further, as the plate portion 74 rotates, such rotation of the plate portion 74 is in an oscillating manner due to drive shaft axis 58 being axially off-set from the plate portion axis or rotatable member axis 72. The plate portion 74 of the rotatable member 24 may be sized with a pre-determined diameter so as to allow for the oscillation of the plate portion 74 within the container 22. In other words, an inner diameter of the container 22 is larger than the diameter of the plate portion 74, the difference being at least about twice a distance 122 between the drive shaft axis 58 and the plate portion axis. With this arrangement, the torque necessary to drive the rotatable member 24 is substantially minimized since the motor 26, in substantial part, is only rotating the counter-weight portion 76 of the rotatable member. As previously set forth, rotation of the plate portion 74 is facilitate,d through the energy generated or centrifugal force of the counter-weight portion 76.

In another embodiment, as may be appreciated by one of ordinary skill in the art, the drive shaft 56 may be directly coupled to the plate portion (without a counter-weight portion as part of the rotatable member) such that the drive shaft 56 is coupled along the plate portion axis 72. However, in this embodiment, a larger motor may be required that can handle a larger amount of torque.

Now with reference again to FIGS. 1 and 2, a method for employing the resurfacing system 20 will now be set forth. A user may access an opening of the container 22 via, for example, removing the upper wall or lid 38 of the container 22. The user may then place one or more lacrosse balls 15 within the ball scuff space 30 of the container 22. The lid 38 may then be replaced back onto the container 22 by the user. With the resurfacing system 20 coupled to a power source, such as a plug outlet or a battery pack, the user may move the switch to an on position for the motor 26 to drive the drive shaft 56. Rotation of the drive shaft 56 also rotates the rotatable member 24. In one embodiment, the plate portion 74 of the rotatable member 24 rotates via the centrifugal force generated by the counter-weight portion 76 being rotated by the drive shaft 56 with the axes of the plate portion 74 and the drive shaft 56 being off-set a distance 122. In another embodiment, the rotatable member 24 may rotate with the drive shaft 56 directly coupled to the plate portion 74. In either case, as the plate portion 74 rotates so that the one or more lacrosse balls 15 also move within the ball scuff space. In one embodiment, the one or more lacrosse balls 15 bump into the bumper portion 40 positioned on the interior surface of the side wall 32 of the container 22. Such humping of the one or more lacrosse balls 15 disrupts any consistent movement of the one or more balls in the container 22 to randomly bounce within the ball scuff space and against the abrasive surface 28 of the rotatable member 24. In one embodiment, the abrasive surface 28 is disposed over a conformable material so that as the one or more balls 15 bounce and impact against the abrasive surface 28, the abrasive surface 28 automatically conforms or cups the ball upon impact (see FIG, 2A) to scuff and scrap a larger surface area of the ball 15 than if the ball was being scuffed against a rigid surface that does not conform to such impact. Over a period of time, for example, one to two minutes with, for example, ten to thirteen lacrosse balls 15 within the container 22, the user may then switch the resurfacing system 20 to the off position via the switch 62. The user may then remove several balls 15 to determine if the balls have sufficiently been scuffed and restored. The user may further determine if the balls have sufficiently been resurfaced by washing the balls with for example, a liquid soap. Once washed, if the balls have a grip stuface, the balls have sufficiently been resurfaced and restored. If not, the user may again place the balls within the container to undergo the resurfacing process.

Now with reference to FIGS. 5-8, another embodiment of a resurfacing system 140 for a single lacrosse ball 15 is provided. This embodiment includes similar components as that set forth in the previous embodiments described and depicted with respect to FIGS. 1-4, except a drive shaft axis 142 of this embodiment is co-axial or substantially the same as a rotatable member axis 144. Such drive shaft axis 142 may also be the same as a central axis 145 for the body of the resurfacing system. The resurfacing system 140 of this embodiment may be portable and therefore, be employed at any location, including locations bere a power outlet may not be readily accessible. Further, the resurfacing system of this embodiment may be sized so as to be readily kept in a backpack or sports bag as a component for ready access for a lacrosse team or a single player.

Figure 5:
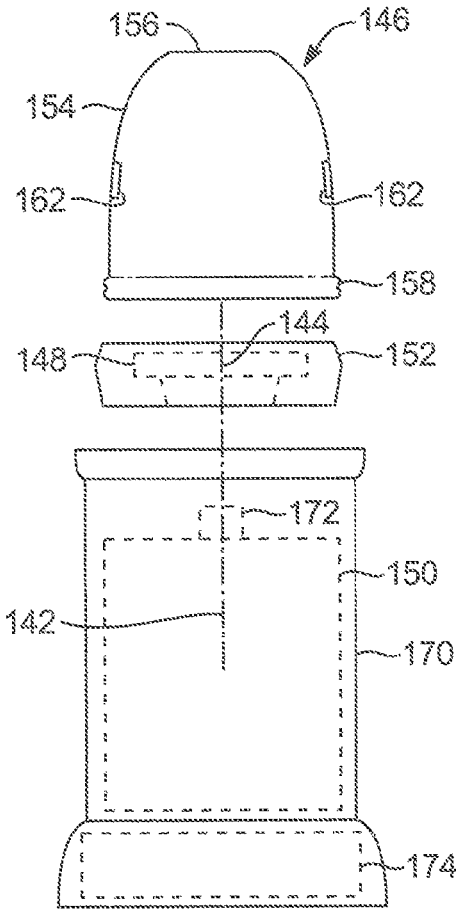
FIG. 5 is an exploded side view of another embodiment of various components of a resurfacing system for a single lacrosse ball, according to the present invention.
Figure 6:
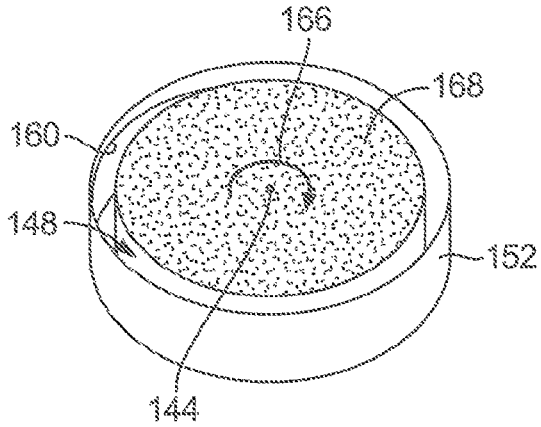
FIG. 6 is a perspective view of a rotatable member of the resurfacing system of FIG. 5, according to another embodiment of the present invention.

With respect to FIGS. 5 and 6, the resurfacing system 140 may include a container 146, a rotatable member 148, and a motor 150. The container 146 is sized and configured to hold a single lacrosse ball 15 and may be coupled to the rotatable member 148 via an intermediate housing 152. The container 146 may include a cylindrical shape or dome shape and define one open end. In other words, the container 146 may include a side wall 154 extending to an upper wall 156 defined by an exterior surface and an interior surface of the container 146. The side wall 154 may include a threaded portion 158 at a lower end of the exterior surface of the container 146 sized and configured to wind and couple to threads 160 defined in the intermediate housing 152. The container 146 may be made from a polymeric material, such as a transparent polymeric material. The interior surface of the container 146 may include a bumper portion 162, integrally and monolithically formed within the interior surface of the container 146, and sized and configured to protrude from the interior surface. As discussed in previous embodiments, upon rotational movement of the rotatable member 148, the bumping portion 162 is configured to bump the lacrosse ball 15 and to substantially disrupt consistent movement of the lacrosse ball within the container 146.

Figure 7:
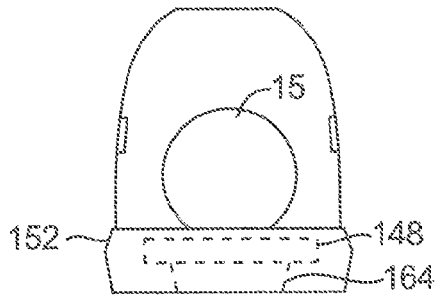
FIG. 7 is a side view of a container positioned over tthe rotatable member, according to another embodiment of the present invention.

Now with reference to FIGS. 5-7, the rotatable member 148 may be disposed within the intermediate housing 152 and may be coupled directly to an intermediate drive member 164. Upon coupling the intermediate housing 152 to the motor 150, the motor 150 may rotate the rotatable member 148, as indicated by rotational arrow 166, about the rotatable member axis 144. As in the previous embodiments, the rotatable member 148 may include an abrasive surface 168. The abrasive surface 168 may be substantially flat or the abrasive surface 168 may include a slight radius in a concave manner. The abrasive surface 168 may be of a material that is conformable such that upon the lacrosse ball 15 contacting the abrasive surface 168, the abrasive surface 168 conforms and cups the lacrosse ball, similar to the previous embodiments. The abrasive surface 168 may he an abrasive foam material. In another embodiment, the abrasive surface 168 may be sandpaper adhesively attached to one or more foam layers, as described in previous embodiments. The abrasive surface 168 may also be a rigid material or formed over a rigid member.

The motor 150 may be mounted within a motor housing 170. The motor 150 may include a motor drive member 172 or drive shaft extending vertically upward from the motor 150. Further, the motor housing 170 may include an upper portion defining an opening sized and configured to receive the intermediate housing 152 such that the intermediate drive member 164 couples to the motor drive member 172. The motor housing 170 may also house a battery pack 174 for providing power to the motor 150. Such a battery pack 174 may be removeable and rechargeable via a power outlet (not shown). In this manner, the resurfacing system 140 powered via the battery pack 174 may be employed at any time or place so long as the battety pack 174 is appropriately charged.

As depicted in FIG, 8, the resurfacing system 140 may be employed by placing a single lacrosse ball 15 within the container 146 and then coupling the container 146 to the intermediate housing 152. The user may then place the intermediate housing 152 into the upper portion of the motor housing 170. The intermediate drive member 164 in the intermediate housing 152 then couples to the motor drive member 172 of the motor 150. The user may then switch the motor 150 to the on position, either by a SW itch or by simply pressing downward with a force on the container 146, as indicated by arrow 176, to switch a spring-biased actuator 178 to power the motor 150, as known to one of ordinary skill in the art. The motor drive member 172 can then rotate the rotatable member 148. Similar to the previous embodiments, rotation of the rotatable member 148 moves the lacrosse ball 15 randomly within the container 146 so that the abrasive surface 168 scuffs the exterior surface of the lacrosse hall 15. As previously set forth, the bumper portions 162 of the container 146 further ensure the ball 15 to randomly move and bounce within the container 148. With this arrangement, the resurfacing system 140 may be employed for a single lacrosse ball 15 in a portable ready-to-use manner.

Figure 8:
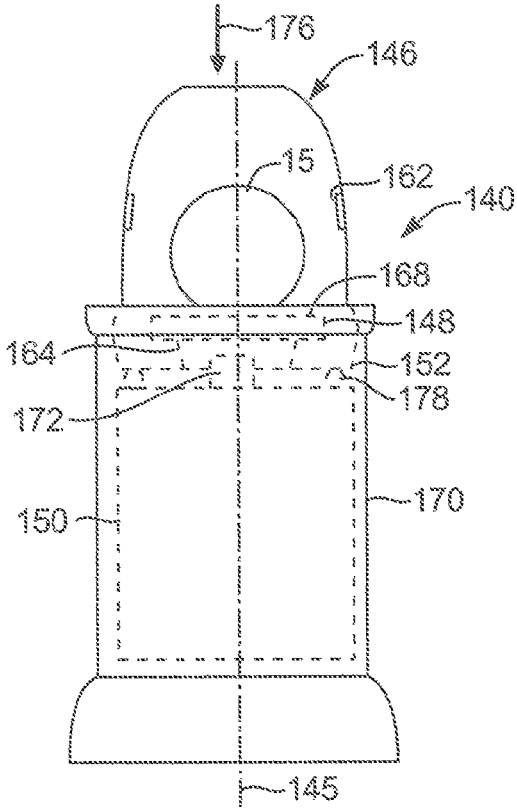
FIG. 8 is a side view of the resurfacing system for a single lacrosse ball, depicting the resurfacing system being moved to an in-use position, according to another embodiment of the present invention.
Figure 9:
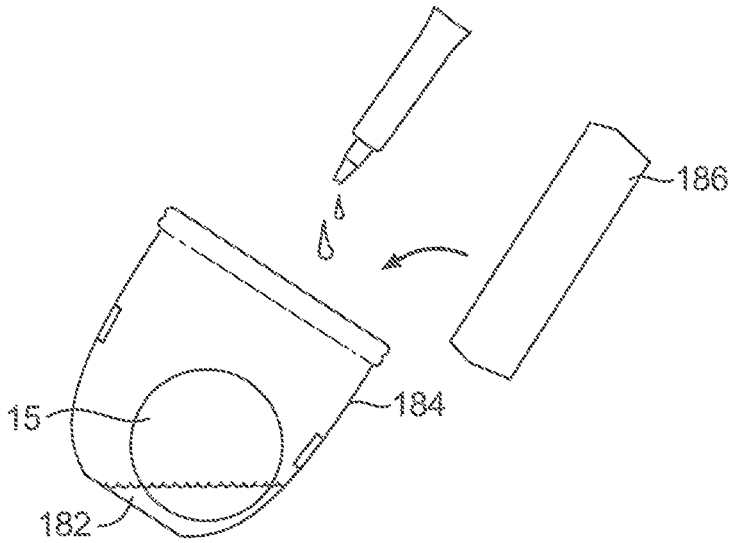
FIG. 9 is a side view of a portion of the resurfacing system, depicting one or more fluids being added to the container to be attached over the rotatable member, according to another embodiment of the present invention.
Figure 10:
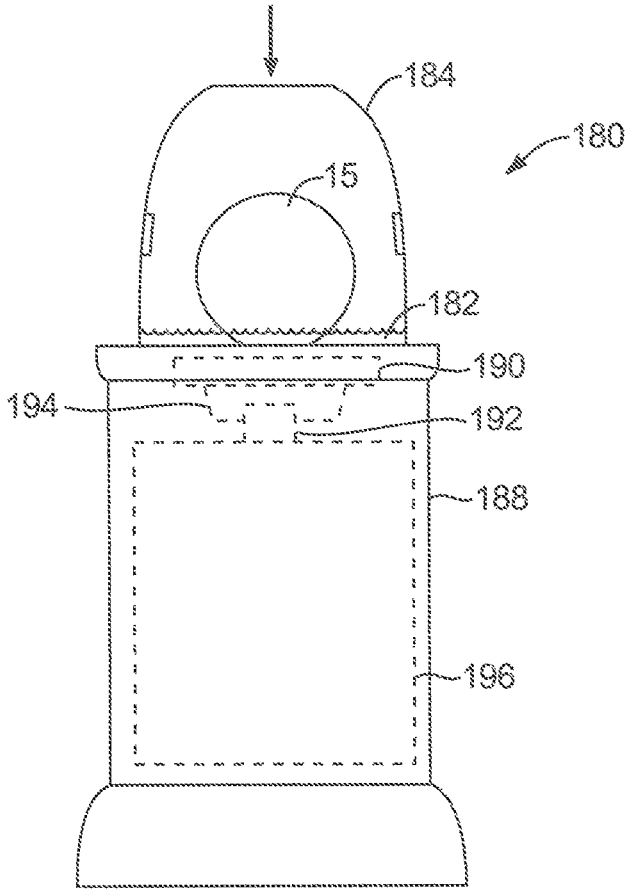
FIG. 10 is a side view of the resurfacing system for a single lacrosse ball, depicting the resurfacing system being moved to an in-use position with liquid disposed in the container along with the rotatable member, according to another embodiment of the present invention.

Now with reference to FIGS. 9-10, another embodiment of a resurfacing system 180 is provided. This embodiment includes the same components as the resurfacing system described and depicted in FIGS. 5-8. In this embodiment, the resurfacing system 180 may be employed with a fluid 182. For example, as depicted in FIG. 9, a fluid 182 may be added to the container 184 with the single lacrosse ball 15. The fluid 182 may include multiple parts, such as a water portion, a degreaser portion, and/or a UV light inhibitor, andlor any other suitable chemical/fluid portion, as known to one of ordinary skill in the art, that facilitates removing grease or dirt from the ball andlor provides a UV light inhibitor. The UV light inhibitor may be helpful since UV light may contribute to quickly causing the lacrosse balls becoming slick. The intermediate housing 186, with the rotatable member 190 disposed therein, may then be coupled to the container 184 with a sealing tit. Such sealing fit may be employed with a polymeric ring or the like at, for example, adjacent the threads in the intermediate housing 186. Similar to the previous embodiment, the intermediate housing 186 may then be coupled to the motor housing 188, thereby, coupling the motor chive shaft 192 to the intermediate drive member 194. Further, the motor 196 maybe turned on by pressing downward on the container or, alternatively, by moving a switch to the on position, as previously set forth. The abrasive surface of the rotatable member 190, along with the fluid 182 added to the container 184, may then scuff and resurface the lacrosse ball 15. Such scuffing of the lacrosse ball 15 by the rotatable member may be employed for one to two minutes, after which, the ball may be removed, an dried or dried off with a cloth, and examined if the ball has been sufficiently resurfaced.

In another embodiment, the lacrosse balls 15 may be employed with the above-described resurfacing systems 20, 140, and 180 set forth in FIGS. 1, 8, and 10, and once removed from the system, the ball may receive a liquid having a UV light inhibitor therein. The liquid may be dispensed in the form of a spray. The person holding the ball may spray the ball three to six inches from a dispenser containing the liquid with three to four sprays while rotating the ball in one's hand. The person may then employ a damp cloth to rub the liquid spray into the ball to ensure the ball is fully and evenly covered with the liquid having the UV light inhibitor. The UV light inhibitor will adhere to the rubber on the ball and form a UV light barrier around the ball. The liquid may be applied to balls once a week during times of heavy use and once every one to three months during times of minimal use. In another embodiment, the liquid may be applied to new balls, prior to employing the resurfacing systems described herein, in order to initially protect the lacrosse balls from UV light.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A resurfacing system for resurfacing one or more lacrosse balls, comprising:

a container configured to contain the one or more lacrosse balls, the container including a side wall defining an interior surface and an exterior surface of the container;

a rotatable member including an abrasive surface and at least one resilient material layer, the at least one resilient material layer adhered to and positioned under the abrasive surface so that the abrasive surface is conformable, the abrasive surface being at least one of sand paper and an abrasive coating, the abrasive surface configured to scuff the one or more lacrosse balls contained in the container; and a motor with a drive shaft coupled to the rotatable member and configured to facilitate rotation of the rotatable member;

one or more bumpers positioned directly on the interior surface, the one or more bumpers configured to disrupt consistent movement of the one or more lacrosse balls in the container upon movement of the rotatable member.

2. The resurfacing system of claim 1, wherein the rotatable member includes a rotatable member central axis and the drive shaft defines a drive shaft axis, wherein the central axis is non-coaxial with the drive shaft axis.

3. The resurfacing system of claim 1, wherein the rotatable member includes a central axis and the drive shaft defines a drive shaft axis, wherein the central axis and the drive shaft axis are co-axial.

4. The resurfacing system of claim 1, wherein the rotatable member comprises a plate portion and a counter-weight portion, the counter-weight portion sized and configured to oscillate and rotate the plate portion.

5. The resurfacing system of claim 1, wherein the rotatable member comprises a plate portion with the abrasive surface and a counter-weight portion, the counter-weight portion rotatably coupled to the plate portion and directly coupled to the drive shaft of the motor.

6. The resurfacing system of claim 5, wherein the drive shaft defines a drive shaft axis, the drive shaft axis is non-coaxial with a central axis of the plate portion.

7. The resurfacing system of claim 5, wherein, upon rotational movement of the counter-weight portion via the drive shaft, the counter-weight portion rotates the plate portion with centrifugal force generated by the counter-weight portion.

8. The resurfacing system of claim 1, further comprising a timer associated with the motor, the timer configured to automatically turn the motor off after a pre-determined period of time.

9. A method for resurfacing an exterior surface of one or more lacrosse balls, the method comprising:

placing one or more lacrosse balls into a container such that each of the one or more lacrosse balls have an exterior surface in a first state and such that each of the one or more lacrosse balls are placed in a ball scuff space defined by an interior surface of the container and an abrasive surface of a rotatable member, the interior surface extending parallel with an exterior container surface of the container;

rotating the rotatable member with a motor operably coupled thereto such that movement of the rotatable member moves the one or more lacrosse balls within the container to freely and randomly bounce the one or more lacrosse balls against the interior surface of the container and the rotatable member; and scuffing the one or more lacrosse balls within the container by bouncing the one or more lacrosse balls against the abrasive surface of the rotatable member such that the exterior surface of each of the one or more lacrosse balls is in a final second state, the final second state having a greater grip surface than the first state.

10. The method according to claim 9, wherein the rotating comprises rotating the rotatable member so that the one or more lacrosse balls move against a bumper disposed on the interior surface of the container for disrupting consistent movement of the one or more lacrosse balls within the container.

11. The method according to claim 9, wherein the rotating comprises rotating a counter-weight of the rotatable member with a drive shaft of the motor, the drive shaft having a drive shaft axis that is non-coaxial with the central axis of the rotatable member.

12. The method according to claim 9, wherein the rotating comprises rotating a counter-weight portion of the rotatable member with a drive shaft of the motor, the rotatable member including a plate portion having the abrasive surface and the counter-weight portion rotatably coupled to an under-side of the plate portion, the drive shaft having a drive shaft axis that is non-coaxial with the central axis of the rotatable member.

13. The method according to claim 9, wherein the rotating comprises driving the rotatable member with a drive shaft of the motor, the drive shaft being co-axial with a central axis of the rotatable member.

14. The method according to claim 9, wherein the placing comprises dispensing a liquid in the container with the one or more lacrosse balls.

* * * * *